United States Patent [19]

Kakinoki et al.

[11] Patent Number: 4,910,805

[45] Date of Patent: Mar. 27, 1990

[54] KNIT OR WOVEN FABRIC

[75] Inventors: Hideo Kakinoki, Tokyo; Shiro Nishikawa, Chiba, both of Japan

[73] Assignee: Dainippon Ink & Chemicals, Inc., Tokyo, Japan

[21] Appl. No.: 376,179

[22] Filed: Jul. 7, 1989

Related U.S. Application Data

[63] Continuation of Ser. No. 282,854, Dec. 9, 1988, abandoned, which is a continuation of Ser. No. 47,388, May 8, 1987, abandoned.

[30] Foreign Application Priority Data

May 9, 1986 [JP] Japan ..... 61-104717

[51] Int. Cl.[4] ..... D04C 1/06; D04C 3/00; D04C 1/00; A41D 27/00

[52] U.S. Cl. ..... 2/243 A; 66/202; 87/6; 87/9; 139/429

[58] Field of Search ..... 2/243 A; 66/202; 87/6, 87/9; 139/429

[56] References Cited

U.S. PATENT DOCUMENTS

| | | | |
|---|---|---|---|
| 348,003 | 8/1886 | Simon | 139/428 |
| 1,591,902 | 10/1922 | Weinberg | 5/482 |
| 1,897,051 | 2/1933 | Hemmench | 66/178 |
| 2,001,676 | 5/1935 | Gastrich | 66/202 |
| 2,327,104 | 8/1943 | Gudebrod | 87/6 |

OTHER PUBLICATIONS

Open Application—West Germany Class 139, Subclass 352, No. P26 20 563.0—Published Nov., 1977.

*Primary Examiner*—Werner H. Schroeder
*Assistant Examiner*—Jeanette E. Chapman
*Attorney, Agent, or Firm*—Armstrong, Nikaido, Marmelstein, Kubovcik & Murray

[57] ABSTRACT

A knit or woven fabric that can be produced from raw silk on a commercial scale and found that this object can be attained by a knit or woven fabric that employs a tubular braid made from raw silk which is optionally blended with other fibers. The present invention has been accomplished on the basis of this finding.

15 Claims, No Drawings

KNIT OR WOVEN FABRIC

The present application is a continuation application of Ser. No. 282,854 filed Dec. 9, 1988, now abandoned, which was a continuation of S.N. 047,388 filed May 8, 1987, now abandoned.

BACKGROUND OF THE INVENTION

The present invention relates to a novel and useful knit or woven fabric. More particularly, the present invention relates to a braid of raw silk, as well as a knit or woven fabric that employs such a braid and which is improved in such characteristics as warmth, moisture absorption, comfort, air permeability, wear resistance and luster.

The use of raw silk as a textile fiber predates written history. The continuous filaments unwound from cocoons are degummed and twisted together to form multifilament yarns which are then woven into a fabric form. Because of the nature of raw silk, the twisted silk yarns will project outwardly in a loop when slackened. This phenomenon is not deleterious to the purpose of making a woven fabric but in knitting operations, needles will get stuck by the loop and may break. In order to avoid the occurrence of frequent troubles on a knitting machine due to the looping of silk yarns, the machine has to be operated at a speed at least ten times slower than when it is used to knit cotton or nylon yarns. Another problem associated with the knitting silk yarns is that holes sometimes occur in the fabric to reduce the yield of acceptable products. For these principal reasons, no commercial production of knit fabrics is currently undertaken on the basis of raw silk. Further, textile fabric made from the knitting have been disadvantageous in that a surface of the fabric may have an undesirable striped pattern.

SUMMARY OF THE INVENTION

The present inventors made concerted efforts to develop a knit or woven fabric that can be produced from raw silk on a commercial scale and found that this object can be attained by a knit or woven fabric that employs a tubular braid made from raw silk which is optionally blended with other fibers. The present invention has been accomplished on the basis of this finding.

DETAILED DESCRIPTION OF THE INVENTION

The raw silk used in the present invention may be any of the known types of silk such as silk, Tussah silk, Moga silk, Eria silk and Yamamai silk. In addition to silk, Tussah silk and Moga silk which are currently produced in large quantities are preferably used as raw silk in the present invention. Such a raw silk may be blended with other fibers except raw silk such as synthetic fibers (e.g. nylon, polyester, polyamide, polyurethane, acrylic and acetate) and natural fibers (e.g. cotton and hemp). The braid which is employed in the fabric of the present invention is made by intertwining at least three, preferably 3–50, more particularly 6–32, in number of filaments of raw silk into a tubular form. The term "tubular form" means a hollow structure whose peripheral wall is formed of intertwined filaments of raw silk and which has a round (e.g. circular or elliptical) cross section in its radial direction. The braid is composed of a set of fibers that cross each other by running at oblique angles with respect to its longitudinal direction, the fibers preferably crossing each other as they run as if they were threads of left- and right-hand screws.

If raw silk is used as the sole component of the braid, its deguming may be effected either before or after the braid is made. If raw silk is blended with other kind of fibers, it is preferably deguming and processed into a silk yarn before braiding. Braids solely made of war silk may be knitted or woven to make an all silk-fabric. From an economic viewpoint and in order to incorporate the features of various fibers, braids which are a blend of raw silk and other fibres may be employed to make a knit or woven fabric. The blending ratio of raw silk to other fibers ranges from 10:90 to 100:0 (wt%), preferably from 50:50 to 99.1:0.1.

Braiding may be achieved with any of the knitting machines that are conventionally used to make braids from cotton or synthetic fiber yarns, and an example is a circular knitting machine intended to make 4-,8- or 16-th stitch braids. The tubular braid used in the present invention has no elongation in its longitudinal direction (parallel to its axis) and is pliable to a force that acts in its transversal (radial) direction Because of these mechanical properties, the braid when used as a textile yarn will neither slack on a knitting machine nor project laterally in a loop form. Instead, the braid will have smooth engagement with needles and permits the machine to be operated with needles and permits the machine to be operated at a faster speed without breaking the needles.

The braid used in the present invention has a fineness that ranges from 56 to 1,000 den (deniers), preferably from 120 to 600 den. Therefore, the finest braid will be formed from four filaments of 14 den each ($4\times14$ den$=56$ den) and other combinations will produce larger braids having varying thicknesses. Most preferably, 6–32 filaments of 21–70 den are intertwined to make a single braid. A plurality of the resulting braids are processed into knit or woven fabrics by means of conventional knitting or weaving machines.

The knit or woven fabric of the present invention is chiefly used as a garment. The term "knit fabric" as used herein includes within its definition hosiery, sweaters, cardigans, boleros, jackets, pullovers, suits, vests, coats, foundations, underwear (e.g. under-shirt and under-shorts), blouses, leggings, skirts, tights, wedding dresses, shirts, trunks, pants, trousers, clothes in general, overcoats, mufflers, scarfs, gloves, caps, hats, neckties, sanitary materials, bathing suits, etc. The term "woven fabric" as used herein includes in its category Kimono (Japanese cloths), Haori (Japanese half-coat), coats, neckties, etc.

Using tubular braids, the knit or woven fabric of the present invention presents a particularly good luster and provides efficient air permeation. In addition, this fabric is far superior in moisture absorption, warmth, wear resistance and comfort as compared with the conventional product made from twisted silk yarns. These advantages of the fabric of the present invention become particularly noticeable when it is a knit fabric.

The following example and comparative example are provided for the purpose of further illustrating the present invention but are in no sense to be taken as limiting.

EXAMPLE 1

A plurality of all silk cylindrical braids (400 den) were processed on a knitting machine (14 gage) to form a fabric for sweater at a speed of 7cm/min. The yield of acceptable products was 90%. The sweater produced form the resulting fabric was highly lusterous, had good air permeability, moisture absorption, heat insulation and wear resistance, was light and warm, and comfortable to wear. This fabric did not have a striped pattern on the surface thereof.

COMPARATIVE EXAMPLE 1

Twisted silk yarns (400 den) were processed into a fabric for sweater on a knitting machine which was of the same type as used in Example 1 but which was operated at a speed twelve times as slow as the usual speed. The yield of acceptable products was only 40 %. This fabric did have a striped pattern.

What is claimed is:

1. A knit fabric formed by knitting a plurality of tubular braids as yarns, each of said tubular braids being formed by round braiding silk yarns, each of said silk yarns being formed by intertwining a plurality of filaments of raw silk, wherein said tubular braids are hollow and have a round crosssection in their radial direction.

2. A knit fabric according to claim 1, wherein the raw silk is selected from a group consisting of silk, Tussah silk and Moga silk.

3. A knit fabric according to claim 1, wherein each of said braids is made of at least three silk yarns.

4. A knit fabric according to claim 1, wherein each of said braids has a fineness of 56–,000 deniers.

5. A knit fabric according to claim 1, which is a machine-made knit fabric.

6. A fabric formed by weaving a plurality of tubular braids as yarns, each of said braids being formed by round braiding of silk yarns, each of said silk yarns being formed by intertwining a plurality of filaments of raw silk, wherein said tubular braids are hollow and have a round cross-section in their radial direction.

7. A woven fabric according to claim 6, wherein the raw silk is selected from a group consisting of silk, Tussah silk and Moga silk.

8. A woven fabric according to claim 6, wherein each of said braids is made of three silk yarns.

9. A woven fabric according to claim 6, wherein each of said braids has a fineness of 56–1,000 deniers.

10. A knit fabric according to claim 1, wherein each of said braids has a fineness of 120–600 deniers.

11. A woven fabric according to claim 6, wherein each of said braids has a fineness of 120–600 deniers.

12. A knit fabric according to claim 1, wherein each braid comprises 6–32 yarns.

13. A woven fabric according to claim 6, wherein each braid comprises 6–32 yarns.

14. A knit fabric according to claim 1, wherein the raw silk filaments are blended with other fibers.

15. A woven fabric according to claim 6, wherein the raw silk filaments are blended with other fibers.

* * * * *